United States Patent [19]

Lancaster

[11] 4,299,004

[45] Nov. 10, 1981

[54] POWERED HAND TOOL FOR USE IN HOUSEHOLD CLEANING OPERATIONS

[76] Inventor: Lorine E. Lancaster, P.O. Box 1016, San Joaquin, Calif. 93660

[21] Appl. No.: 102,643

[22] Filed: Dec. 12, 1979

[51] Int. Cl.[3] ..... A46B 13/02

[52] U.S. Cl. ..... 15/97 R; 15/28; 51/170 T; 310/50

[58] Field of Search ..... 15/22 R, 28, 29, 97 R, 15/93, 23, 24; 51/170 T; 310/50

[56] References Cited

U.S. PATENT DOCUMENTS

| | | | |
|---|---|---|---|
| 1,142,482 | 6/1915 | Bisch | 15/28 X |
| 2,944,271 | 7/1960 | Foster et al. | 15/28 |
| 3,240,966 | 3/1966 | Thompson | 15/28 X |
| 3,417,417 | 12/1968 | Rhodes | 15/28 X |
| 3,638,264 | 2/1972 | Walton | 15/29 X |
| 3,715,770 | 2/1973 | Obregon-Gomez | 15/28 X |
| 4,024,597 | 5/1977 | Fouracre | 15/28 |
| 4,137,588 | 2/1979 | Sandt et al. | 15/28 X |
| 4,158,246 | 6/1979 | Meadows et al. | 15/28 |

*Primary Examiner*—Edward L. Roberts
*Attorney, Agent, or Firm*—Huebner & Worrel

[57] ABSTRACT

The tool includes a water-tight housing of an elongated configuration having a handle defined therein, an electrically energizable motor mounted in the housing and having a rotary output shaft therefor; a pair of wells spaced 90° apart are provided in the housing as receptacles for a pair of sockets mounted on normally related drive shafts connected with the motor adapted to receive one of a plurality of polishing wheels mounted on shafts, whereby the polishing wheels are interchangeably related to the sockets.

1 Claim, 6 Drawing Figures

POWERED HAND TOOL FOR USE IN HOUSEHOLD CLEANING OPERATIONS

BACKGROUND OF THE INVENTION

1. Field of the Invention

The invention generally relates to a tool for use in household cleaning operations, such as in the scrubbing of cooking utensils, and more particularly to a powered hand tool particularly suited for use in cleaning utensils, such as cooking pots and the like.

It generally is well recognized that household scrubbing and cleaning operations often require that the tools employed be of a suitable size and shape in order to render them effective. For example, it frequently becomes necessary to apply pressure downwardly while performing scrubbing operations. Consequently, it is preferred that the tool be so shaped and balanced to accommodate application of downwardly applied pressure. In some instances, it is necessary for a tool to be inserted deeply into a narrow opening of a container in order to facilitate its usage. Consequently, the tool must be so shaped and configured to accommodate the required insertion. Finally, such a tool must be sufficiently practical to make its use desirable, sufficiently economic to permit its being purchased by those desiring to use it, and be sufficiently portable, water-tight, and durable as to accommodate the requirements of heavy-duty utensil cleaning operations. Unfortunately, of all the tools known to the instant inventor, none meet all the enumerated requirements.

2. Description of the Prior Art

During the course of a preliminary search conducted for the invention, the following patents were discovered:

U.S. Pat. No. 3,715,770—Obregon-Gomez—Feb. 13, 1973

U.S. Pat. No. 4,137,588—Sandt et al—Feb. 6, 1979

The patent to Sandt et al, U.S. Pat. No. 4,137,588, discloses a portable, battery-operated, hand-held cleaning device adapted to receive in driving relation various cleaning implements such as wire brushes, abrasive wheels and the like. The patent to Gomez discloses a device for washing pots and pans and the like, the device includes a motor having a flexible cable for mechanically powering a hand-held unit which receives various rotatable brushes.

As can be fully appreciated by those who have had an opportunity to work with rechargeable battery operated devices, the inconvenience attributable to the requirement that such devices must be recharged after usage often impairs their utility, particularly where the work is heavy duty in nature and the device must be used on a more or less continuous basis.

With regard to the device disclosed by Gomez, it is believed to be apparent that the use of a flexible cable-drive for the device necessarily tends to greatly impair its utility.

It is at this juncture noted that while the prior art includes devices similar in some respects to the device hereinafter claimed and described, it also is noted that there currently exists a need for a practical and simple powered hand-tool which is particularly adapted for use in performing scrubbing and cleaning operations, particularly for pots of various sizes and shapes, and one which may readily be employed in relatively large operations requiring substantial continuous use of the tool.

It is therefore the purpose of the instant invention to provide a simple, durable, and practical hand-tool having particular utility in continuous-use operations for cleaning pots, pans and the like of differing sizes and shapes, but not limited in use thereto and having further utility in general household cleaning and polishing operations including polishing bright work, silver and the like.

OBJECTS AND SUMMARY OF THE INVENTION

It is an object of the instant invention to provide an improved tool for use in cleaning and scrubbing operations.

It is another object to provide an improved tool for use in cleaning utensils of differing sizes and shapes.

It is another object to provide a simplified, durable and practical tool particularly adapted for substantial continuous use in large kitchens.

It is another object to provide practical, simple, and economically feasible hand tools adapted to be continuously connected with the source of house current and employed in household cleaning and scrubbing operations.

These and other objects and advantages are achieved through the use of an improved tool characterized by an elongated, substantially water-proof housing within which is confined a drive train including an electrically energizable motor adapted to be connected with a source of house current, and a pair of normally related drive shafts on which are mounted sockets externally related to the housing for receiving interchangeable polishing wheels.

DESCRIPTION OF THE PREFERRED EMBODIMENT

Figure 1:
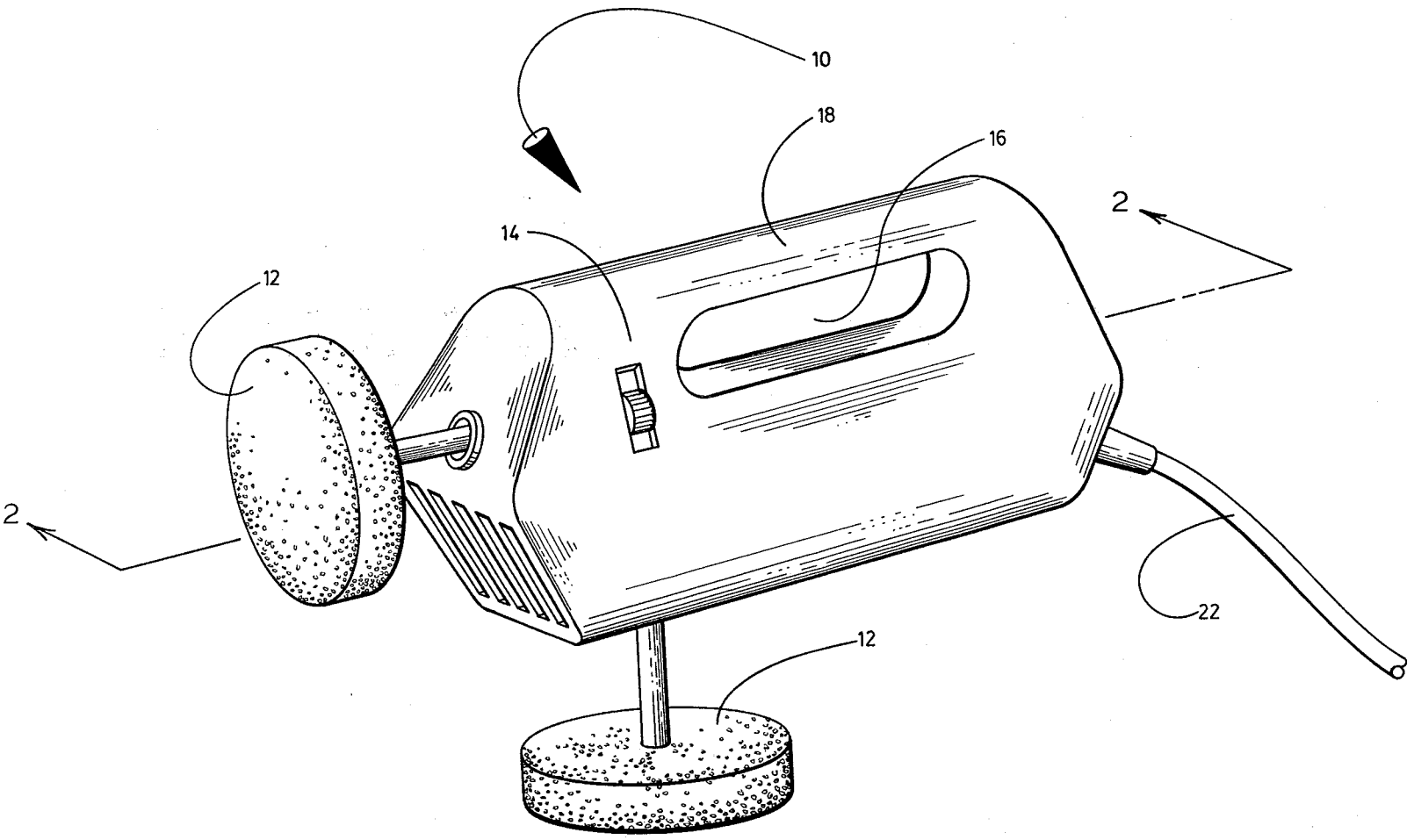
FIG. 1 comprises a perspective view of a tool which embodies the principles of the instant invention.

Referring now to the drawings, with more particularity, wherein like reference characters designate like or corresponding parts throughout the several views, there is shown in FIG. 1 a tool, generally designated 10, embodying the principles of the instant invention.

Figure 4C:
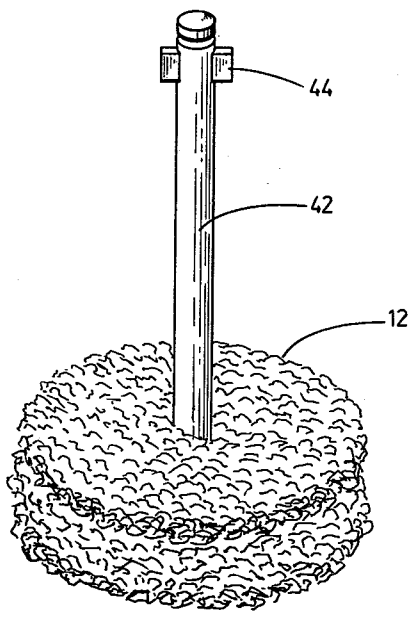
FIGS. 4*a*–4*c* are perspective views depicting abrasive wheels exemplifying polishing wheels adapted to be employed by the device of the instant invention.
Figure 4B:
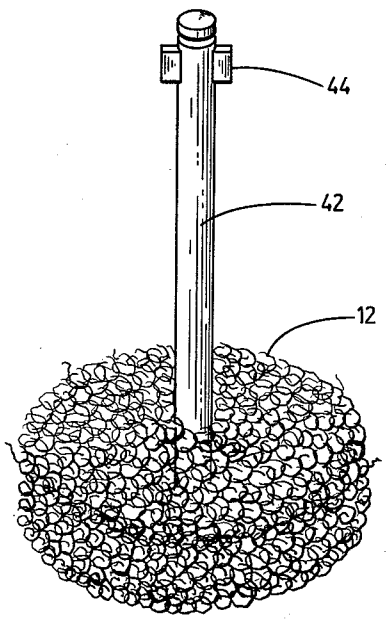
Figure 4A:
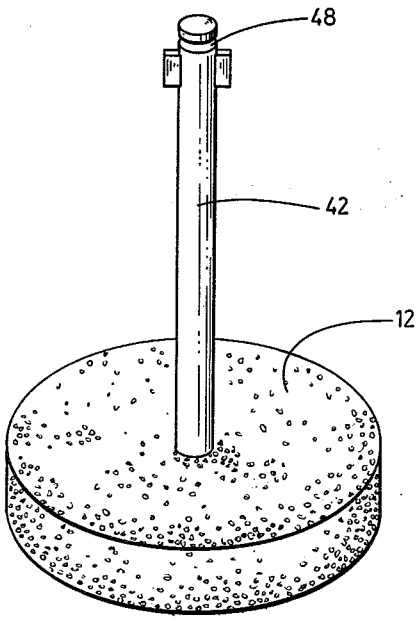

As shown, the tool 10 includes mounted therein a pair of polishing wheels 12. It is important to understand that the term "polishing wheel" is generic and refers to an entire class of abrasive or abrading wheels, having as the purpose thereof, the removal of foreign matter from surfaces such as may be found on the surfaces of cooking utensils, silver, and other surfaces as may be found in and around the home, commercial kitchen, and the like. The polishing wheel 12 is typified by a pumice bar, plastic sponge, steel wool, spirals of steel, spirals of plastic, lamb's wool, felt pad, and the like, similarly configured as depicted in FIGS. 4*a*–4*c*.

The tool 10 includes a substantially water-proof housing preferably formed of a suitable synthetic resin such as PVC or the like. It is important to appreciate that the housing 14, in practice, resists an ingress of water or other liquid materials commonly employed in cleaning operations. Moreover, the housing 14 is so configured as to include therein an opening 16 defining a handle 18 for the tool.

Figure 2:
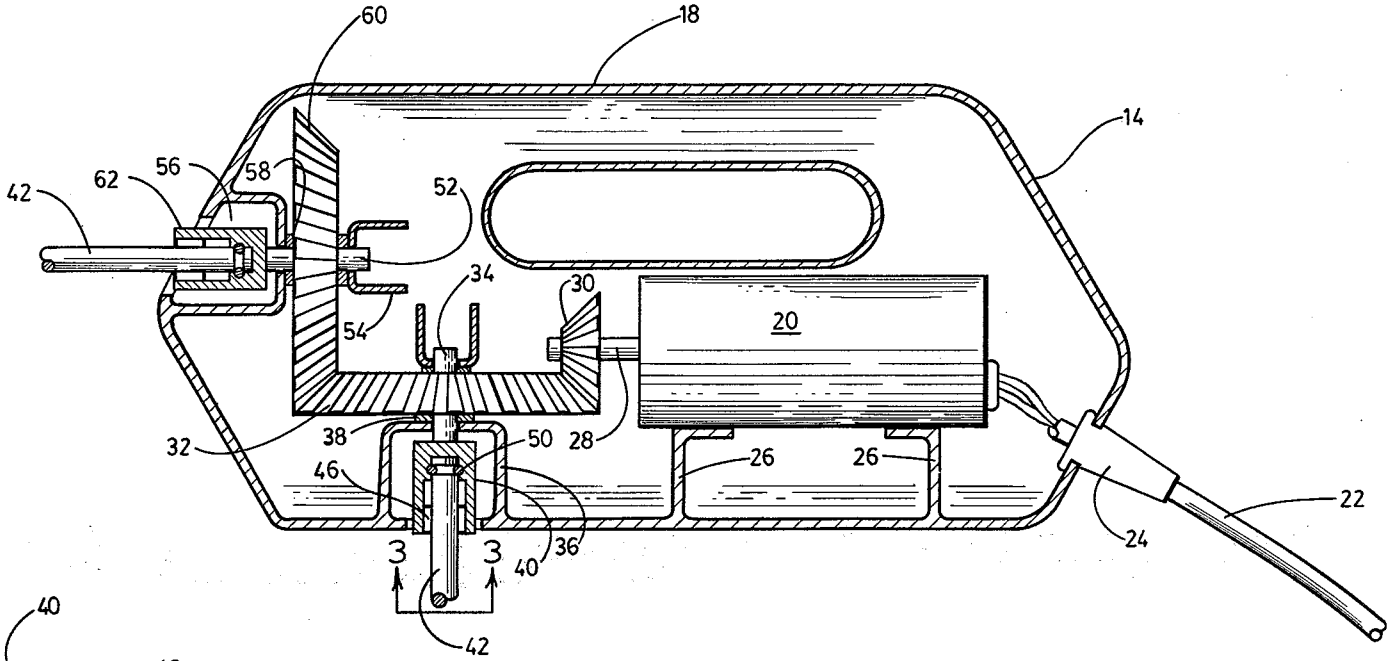
FIG. 2 is a cross-sectional view of the tool taken generally along lines 2—2 of FIG. 1.
Figure 3:
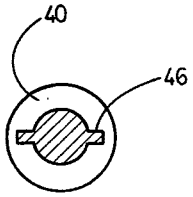
FIG. 3 is a view taken generally along lines 3—3 of FIG. 2.

As best shown in FIG. 2, within the housing 14 there is mounted an electrically energizable motor 20 having an electrical lead 22 exiting the housing 14 through a suitable grummet 24.

This lead facilitates a connection of the motor 20 with a source AC current, such as 110–120 volt house current. Hence, it should be appreciated that the tool 10 may be operated substantially continuously in a manner as is frequently required in large or commercial kitchens and the like.

The motor 20 is mounted within the housing employing suitable brackets 26, the details of which form no specific part of the claimed invention. It suffices to understand that the bracket 26 is of a suitable design and is particularly adapted for securing the motor in place within the housing 14.

The motor 20 is of conventional design and includes a rotary output shaft 28 having affixed thereto a bevel gear 30. This gear is meshed with a bevel gear 32 mounted on and connected with a rotatable drive shaft 34. The drive shaft 34 is, in turn, supported by a suitable bracket, not designated, provided internally of the housing 14. In practice, the housing 14 is so shaped as to include therein a first well 36 into which extends the shaft 34. A suitable packing 38 is provided for establishing and maintaining a water-tight seal about the shaft 34 as it extends into the housing 14.

The shaft 34, within the well 36, supports a coaxially aligned socket 40. This socket is, in turn, of a suitable shape and dimension and is adapted to receive a shaft 42 comprising an integral part of a polishing wheel 12. However, as shown in FIGS. 4*a*–4*c*, the shaft includes a pair of ears 44 defining keys for key-ways 46 provided within the sockets 40. Additionally, each of the shafts 42 is provided with an annular groove 48 for receiving a snap-ring 50, the purpose of which is to resist axial displacement of the shaft 42.

It should now be apparent that the shaft 42 is particularly adapted to be inserted into the socket 40 and be releasably coupled therewith as the ears 44 mate with the key-ways 46 and the snap-ring 50 seat in the groove 48.

Also mounted within the housing 14 there is a further drive shaft 52 mounted on a suitable bracket, designated 54. The shaft 52, like the shaft 34, is extended to a well 56, defined in the housing 14, and includes a packing 58, similar to the packing 38, provided for maintaining water-tight integrity of the housing about the shaft 52. Mounted on and affixed to the shaft 52 there is a bevel gear 60. This gear is mated with the bevel gear 32 so that the gear 32 serves to impart driven rotation to the shaft 52 upon its being driven in rotation by the gear 30.

Within the well 56 there is disposed a further socket 62, being configured similarly to the socket 40 and mounted on the shaft 52. The purpose of this socket is to also receive a shaft 42 of a polishing wheel 12. Since the socket 62 is similar in design and function to the aforedescribed socket 40, a detailed description of the socket 62 is omitted. However, it is to be understood that the socket 62 serves to releasably receive and support in driving relation a shaft 42 for a polishing wheel. It should now be apparent that the shafts 42 are interchangeably relative to the sockets 40 and 62. Hence, the polishing wheels 12 are mountable in either of the sockets for alternative use or, if desired, simultaneously.

OPERATION

It is believed that in view of the foregoing description, the operation of the invention herein described and claimed, is readily apparent; however, in the interest of completeness the operation of the device embodying the invention will, at this point, briefly be reviewed.

With the tool 10 assembled in the manner hereinbefore described, it is readied for operation simply by connecting the lead 22 with a suitable source of house current such as may be found at a conventional outlet in a conventional kitchen or commercial kitchen or the like.

A polishing wheel 12, of a selected nature, from a group including pumice, plastic sponge, steel wool, lamb's wool, spirals of plastic, spirals of steel, felt pads, or the like, is inserted into one of the sockets 40 or 62. In instances where an operator wishes to apply a heavy downward force utilizing the handle 18, provided ample space is available, the socket 40 is selected. Thus the polishing wheel may be utilized to remove foreign substances from surfaces, varying from the surface of silver to the internal surfaces of cooking utensils, grills, and the like.

Of course, in the event it becomes desirable to clean the internal surfaces of a container having a size or dimension such as to preclude use of the tool with the handle 18 oriented transverse to the opening in which the tool is to be used, the polishing wheel is inserted into socket 62. Thus the tool may be inserted axially into the container. Thus the tool 10 may be employed in an axial relationship with respect to a utensil, as well as in a horizontal or diametric relationship with the opening of the container. However, it is to be appreciated that because of the shape and balance of the housing 14, a use of the tool in its horizontal orientation or diametric relationship with respect to an upright container, is preferred.

Also, it should be apparent from a review of FIG. 2, that the gear train defined by the beveled gears 30, 32 and 60 comprises a speed-reduction gear train. Such a gear train accommodates practical operating speeds for polishing wheels, with minimal attendant power requirements for the motor 20.

In view of the foregoing, it is believed to be readily apparent that the tool which embodies the principles of the instant invention provides a practical solution to the problems heretofore plaguing those engaged in household cleaning and scrubbing operations as well as cleaning operations requiring a substantially continuous usage of powered tools in the cleaning and polishing of surfaces such as may be found in kitchens, particularly those commercially oriented.

Although the invention has been herein shown and described in what is conceived to be the most practical and preferred embodiment, it is recognized that departures may be made therefrom within the scope of the invention, which is not to be limited to the illustrative details disclosed.

Having described my invention, what I claim as new and desire to secure by Letters Patent is:

1. A powered hand tool particularly suited for use in cleaning household utensils, such as cooking pots and the like, comprising:

a water-tight housing of an elongated configuration having a handle defined therein and extended in parallelism with the longitudinal axis of the housing;

an electrically energizable AC motor mounted in the housing having a rotary output shaft, and means including a lead for electrically connecting the motor to an external source of AC electrical energy;

means defining in said housing a pair of wells mutually spaced 90° apart relative to the longitudinal axis of said housing;

means including a pair of sockets and a pair of perpendicularly related drive shafts supporting said sockets for rotation within said pair of wells about a pair of normally related axes, the socket of said pair being characterized by a key-way extended axially thereof;

means for imparting continuous unidirectional rotation to each shaft of said pair of shafts including a speed-reduction gear train interconnecting said shafts with said motor; and a plurality of polishing wheels, each wheel having an axially projected shaft characterized by a key integrally related therewith and projected radially therefrom adapted to be received by a key-way defined in each socket of said pair, whereby said polishing wheels are interchangeably related to said sockets.

* * * * *